US008723502B2

(12) United States Patent
Chang et al.

(10) Patent No.: US 8,723,502 B2
(45) Date of Patent: May 13, 2014

(54) BANDGAP REFERENCE VOLTAGE GENERATOR

(71) Applicant: Silicon Motion, Inc., Jhubei (TW)

(72) Inventors: Hui-Ju Chang, Kaohsiung (TW); Shuo-Jyun Hong, Taichung (TW)

(73) Assignee: Silicon Motion, Inc., Jhubei, Hsinchu County (TW)

( * ) Notice: Subject to any disclaimer, the term of this patent is extended or adjusted under 35 U.S.C. 154(b) by 11 days.

(21) Appl. No.: 13/658,414

(22) Filed: Oct. 23, 2012

(65) Prior Publication Data

US 2013/0106393 A1 May 2, 2013

(30) Foreign Application Priority Data

Oct. 26, 2011 (TW) ..... 100138804 A

(51) Int. Cl.
*G05F 3/16* (2006.01)
*G05F 3/28* (2006.01)

(52) U.S. Cl.
USPC ..... 323/313; 323/316; 323/907

(58) Field of Classification Search
USPC ..... 323/311, 312, 313, 314, 316, 907; 327/539
See application file for complete search history.

(56) References Cited

U.S. PATENT DOCUMENTS

| | | | | |
|---|---|---|---|---|
| 5,604,427 | A * | 2/1997 | Kimura | 323/313 |
| 7,301,321 | B1 * | 11/2007 | Uang et al. | 323/313 |
| 7,990,130 | B2 * | 8/2011 | Yoshikawa | 323/313 |
| 2004/0036460 | A1 * | 2/2004 | Chatal | 323/313 |
| 2007/0210784 | A1 * | 9/2007 | Sung | 323/316 |
| 2009/0051341 | A1 * | 2/2009 | Chang et al. | 323/313 |

* cited by examiner

*Primary Examiner* — Gary L Laxton
(74) *Attorney, Agent, or Firm* — McClure, Qualey & Rodack, LLP

(57) ABSTRACT

A bandgap reference voltage generator is provided. In one embodiment, the bandgap reference voltage generator includes a first current generator, a second current generator, and an output voltage generator. The first current generator generates a first current with a positive temperature coefficient. The second current generator generates a second current with a negative temperature coefficient. The output voltage generator generates a third current with a level equal to that of the first current, generates a fourth current with a level equal to that of the second current, adds the third current to the fourth current to obtain a combined current with a zero temperature coefficient, and generates a reference voltage according to the combined current.

12 Claims, 3 Drawing Sheets

BANDGAP REFERENCE VOLTAGE GENERATOR

CROSS REFERENCE TO RELATED APPLICATIONS

This Application claims priority of Taiwan Patent Application No. 100138804, filed on Oct. 26, 2011, the entirety of which is incorporated by reference herein.

BACKGROUND OF THE INVENTION

1. Field of the Invention

The invention relates to reference voltages, and more particularly to reference voltage generation circuits.

2. Description of the Related Art

A reference voltage generator provides a circuit with a reference voltage. An analog circuit needs a reference voltage as a reference for performing accurate operations. For example, both a least significant bit (LSB) of an analog to digital converter and an output voltage of a regulator are determined according to a reference voltage. Thus, a reference voltage generator must generate an accurate and reliable reference voltage to maintain circuit performance.

Most analog circuit components have electrical properties changing with temperature. To prevent the performance of a circuit from changing with temperature variations, even if the temperature changes, the level of the reference voltage generated by a reference voltage generator should not change with the temperature. Referring to FIG. 1A, a circuit diagram of a bandgap reference voltage generator 100 is shown. The bandgap reference voltage generator 100 generates a reference voltage $V_{ref}$ which has a zero temperature coefficient. In other words, the reference voltage $V_{ref}$ generated by the bandgap reference voltage generator 100 does not change with temperature. The bandgap reference voltage generator 100 comprises PMOS transistors 101, 102, and 103, diode-connected BJT transistors 130, 131, . . . , 13N, transistors 121, 122, 123, and 124, and an operational amplifier 150.

The operation of the bandgap reference voltage generator 100 is described as follows. The output voltage of the operational amplifier 150 is coupled to the gates of the PMOS transistors 101, 102, and 103, and the sources of the PMOS transistors 101, 102, and 103 are coupled to the voltage source Vcc. Because the voltage drop across the gates and the sources of the PMOS transistors 101, 102, and 103 are identical, the levels of the currents $I_1$, $I_2$, and $I_3$ passing through the PMOS transistors 101, 102, and 103 are also identical ($I_1=I_2=I_3$). Thus, the reference voltage $V_{ref}$ is derived as the following algorithm:

$$V_{ref} = I_3 \times R_{124} = I_2 \times R_{124} = (I_{2a} + I_{2b}) \times R_{124} \quad (1)$$
$$= [(\Delta V / R_{122}) + V_{162} / R_{123}] \times R_{124}$$

wherein $R_{124}$ is the resistance of the resistor 124, $R_{122}$ is the resistance of the resistor 122, $R_{123}$ is the resistance of the resistor 123, ΔV is the voltage drop across the resistor 122, and $V_{162}$ is the voltage on the node 162.

Because a positive input terminal and a negative input terminal of the operational amplifier 150 are respectively coupled to the nodes 162 and 161, the voltage of the node 162 is identical to that of the node 161, and the reference voltage $V_{ref}$ is derived as the following equation:

$$V_{ref}=[(\Delta V/R_{122})+V_{161}/R_{123}]\times R_{124} \quad (2)$$

wherein $V_{161}$ is the voltage on the node 161. Because the voltage $V_{161}$ on the node 161 is the voltage drop across the BJT transistor 130, the voltage drop $V_{161}$ decreases with an increase of the temperature (referred to as a negative temperature coefficient). The ΔV is the voltage drop across the resistor 122. Because a plurality of BJT transistors 131, . . ., 13N are coupled between a terminal of the resistor 122 and the ground, the voltage drop ΔV therefore increases with an increase of the temperature (referred to as a positive temperature coefficient). Because the reference voltage $V_{ref}$ is a combination of the voltage drop $V_{161}$ with a negative temperature coefficent and the voltage drop ΔV with a positive temperature coefficient, the reference voltage $V_{ref}$ does not change with temperature variations (referred to as a zero temperature coefficent).

Although the bandgap reference voltage generator 100 provides a reference voltage with a zero temperature coefficient, the bandgap reference voltage generator 100 has a deficiency. When the power of the bandgap voltage generator 100 is switched on, the voltage on the node 161 is at the voltage of the ground. The BJT transistor 130, however, is turned on when the voltage of the node 161 is higher than 0.7V. If the voltage of the node 161 is lower than 0.7V, the BJT transistor 130 is turned off, and the current $I_1$ passing through the PMOS transistor 101 flows to the ground via the resistor 121 without passing through the BJT transistor 130. Because the BJT transistor 130 is not turned on, the voltage $V_{161}$ on the node 161 does not have a negative temperature coefficient, and the reference voltage $V_{ref}$ generated according to the equation (2) therefore does not have a zero temperature coefficient. The bandgap reference voltage generator 100 therefore does not operate normally.

Referring to FIG. 1B, a circuit diagram of a starting circuit 170 of the bandgap reference voltage generator is shown. In one embodiment, the starting circuit 170 comprises PMOS transistors 171, 172, and 173, and an NMOS transistor 174. Because the BJT transistor 130 shown in FIG. 1A is not turned on when the power of the bandgap reference voltage generator 100 is switched on, the starting circuit 170 is added to the bandgap reference voltage generator 100 to pull up the voltage of the BJT transistor 130 after the power of the bandgap reference voltage generator 100 is switched on. However, even if the staring circuit 170 is added to the bandgap reference voltage generator 100, the BJT transistor 130 is not assured to always be turned on by the starting circuit 170, and the bandgap reference voltage generator 100 is not ensured of operating normally.

To avoid the deficiency of the conventional bandgap reference voltage generator 100 from occurring, a new-type bandgap reference voltage generator is therefore required.

BRIEF SUMMARY OF THE INVENTION

The invention provides a bandgap reference voltage generator. In one embodiment, the bandgap reference voltage generator comprises a first current generator, a second current generator, and an output voltage generator. The first current generator generates a first current with a positive temperature coefficient. The second current generator generates a second current with a negative temperature coefficient. The output voltage generator generates a third current with a level equal to that of the first current, generates a fourth current with a level equal to that of the second current, adds the third current to the fourth current to obtain a combined current with a zero temperature coefficient, and generates a reference voltage according to the combined current.

The invention also provides a bandgap reference voltage generator. In one embodiment, the bandgap reference voltage generator is coupled between a voltage source and a ground, and comprises a first current generator, a second current generator, a voltage clamp circuit, and an output voltage generator. The first current generator generates a first current with a positive temperature coefficient. The second current generator generates a second current with a negative temperature coefficient. The voltage clamp circuit clamps the voltages on a second node and a third node of the second current generator to the voltage on a first node of the first current generator, and generates a first voltage and a second voltage. The output voltage generator generates a combined current with a zero temperature coefficient according to the first current and the second current, and generates a reference voltage according to the combined current.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 2:
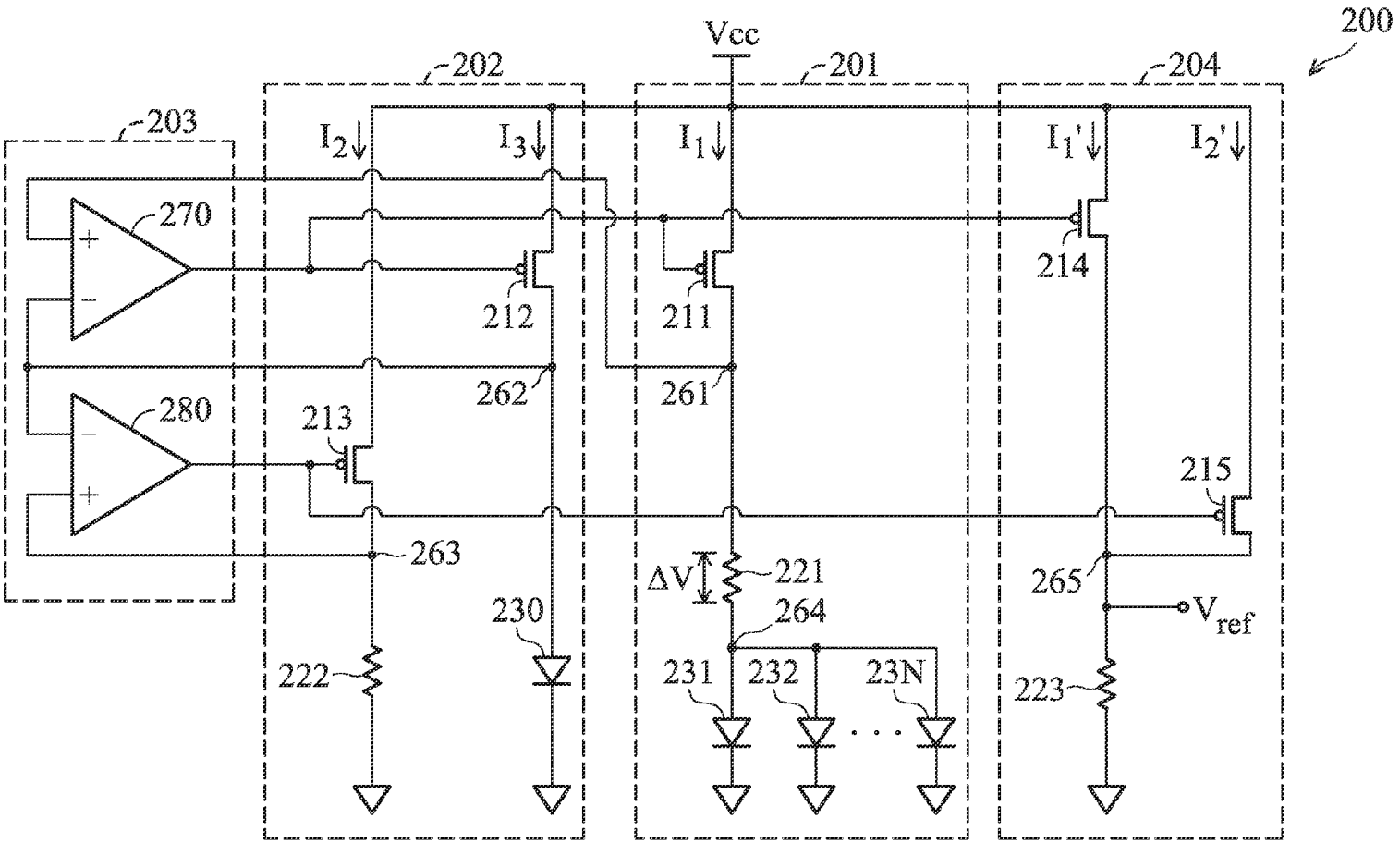
FIG. 2 is a circuit diagram of a bandgap reference voltage generator according to the invention.

Referring to FIG. 2, a circuit diagram of a bandgap reference voltage generator 200 according to the invention is shown. The bandgap reference voltage generator 200 is coupled between a voltage source Vcc and a ground. In one embodiment, the bandgap reference voltage generator 200 comprises a first current generator 201, a second current generator 202, a voltage clamping circuit 203, and an output voltage generator 204. The first current generator 201 generates a current $I_1$ with a positive temperature coefficient. In other words, the current $I_1$ increases with an increase of the temperature. The second current generator 202 generates a current $I_2$ with a negative temperature coefficient. In other words, the current $I_2$ decreases with an increase of the temperature. The voltage clamping circuit 203 clamps the voltages of the nodes 262 and 263 of the second current generator 202 to the voltage of the node 261 of the first current generator 201. The output voltage generator 204 generates a current $I_1'$ with a level equal to that of the current $I_1$ and a current $I_2'$ with a level equal to that of the current $I_2$, adds the current $I_2'$ to the current $I_1'$ to obtain a combined current $(I_1'+I_2')$ with a zero temperature coefficient, and generates a reference voltage $V_{ref}$ with a zero temperature coefficient according to the combined current $(I_1'+I_2')$.

In one embodiment, the voltage clamping circuit 203 comprises two operational amplifiers 270 and 280. The positive input terminal of the operational amplifier 270 is coupled to the node 261 of the first current generator 201, and the negative input terminal of the operational amplifier 270 is coupled to the node 262 of the second current generator 202. The voltage on the node 262 is therefore clamped to the voltage on the node 261. The output terminal of the operational amplifier 270 is coupled to the gates of the PMOS transistors 211, 212, and 214. The positive input terminal of the operational amplifier 280 is coupled to the node 263 of the second current generator 202, and the negative input terminal of the operational amplifier 280 is coupled to the node 262 of the second current generator 202. The voltage on the node 263 is therefore clamped to the voltage on the node 262. The output terminal of the operational amplifier 280 is coupled to the gates of the PMOS transistors 213 and 215.

In one embodiment, the first current generator 201 comprises a PMOS transistor 211, a resistor 221, and a plurality of diode-connected BJT transistors 231, 323, . . . , 23N. The bases of the diode-connected BJT transistors 231, 232, . . . , 23N are coupled to collectors thereof. The PMOS transistor 211 is coupled between the voltage source Vcc and the node 261, and the gate of the PMOS transistor 211 is coupled to the output terminal of the operational amplifier 270. The resistor 221 is coupled between the nodes 261 and 264. The BJT transistors 231, 232, . . . , 23N are coupled between the node 264 and ground. The current $I_1$ flows through the source and the drain of the PMOS transistor 211.

In one embodiment, the second current generator 202 comprises a PMOS transistor 212, a diode-connected BJT transistor 230, a PMOS transistor 213, and a resistor 222. The PMOS transistor 212 is coupled between the voltage source Vcc and the node 262, and the gate of the PMOS transistor 212 is coupled to the output terminal of the operational amplifier 270. The base of the BJT transistor 230 is coupled to the collector thereof, and the BJT transistor 230 is coupled between the node 262 and the ground. The PMOS transistor 213 is coupled between the voltage source Vcc and the ground, and the gate of the PMOS transistor 213 is coupled to the output terminal of the operational amplifier 280. The current $I_2$ flows through the drain and the source of the PMOS transistor 213, and the current $I_3$ flows through the drain and the source of the PMOS transistor 212.

In one embodiment, the output voltage generator 204 comprises PMOS transistors 214 and 215 and a resistor 223. The PMOS transistor 214 is coupled between the voltage source Vcc and the node 265, and the gate of the PMOS transistor 214 is coupled to the output terminal of the operational amplifier 270. The PMOS transistor 215 is coupled between the voltage source Vcc and the node 265, and the gate of the PMOS transistor 215 is coupled to the output terminal of the operational amplifier 280. The current $I_1'$ flows through the drain and the source of the PMOS transistor 214, and the current $I_2'$ flows through the drain and the source of the PMOS transistor 215. The combined current $(I_1'+I_2')$ flows through the resistor 223, and the voltage drop across the terminals of the resistor 223 is the reference voltage $V_{ref}$.

The reference voltage $V_{ref}$ output by the reference voltage generator 204 is therefore as follows:

$$V_{ref}=(I_1'+I_2')\times R_{223} \tag{3}$$

wherein $R_{223}$ is the resistance of the resistor 223. Because the gate of the PMOS transistor 214 and the gate of the PMOS transistor 211 are both coupled to the output terminal of the operational amplifier 270, and the source of the PMOS transistor 214 and the source of the PMOS transistor 211 are both coupled to the voltage source Vcc, the level of the current $I_1'$ flowing through the PMOS transistor 211 is equal to that of the current $I_1$ flowing through the PMOS transistor 214. Similarly, because the gate of the PMOS transistor 215 and the gate of the PMOS transistor 213 are both coupled to the output terminal of the operational amplifier 280, and the source of the PMOS transistor 215 and the source of the PMOS transistor 213 are both coupled to the voltage source Vcc, the level of the current $I_2'$ flowing through the PMOS transistor 215 is equal to that of the current $I_2$ flowing through the PMOS transistor 213. The reference voltage $V_{ref}$ output by the reference voltage generator 204 is therefore as follows:

$$V_{ref}=(I_1+I_2)\times R_{223}=[(\Delta V/R_{221})+(V_{263}/R_{222})]\times R_{223} \quad (4)$$

wherein ΔV is the voltage drop across the terminals of the resistor 221, $R_{221}$ is the resistance of the resistor 221, $V_{263}$ is the voltage on the node 263, and $R_{222}$ is the resistance of the resistor 222.

Because the operational amplifier 280 clamps the voltage of the node 262 to the voltage of the node 263, the voltage of the node 262 is equal to the voltage of the node 263. The reference voltage $V_{ref}$ output by the reference voltage generator 204 is therefore as follows:

$$V_{ref}=(I_1+I_2)\times R_{223}=[(\Delta V/R_{221})+(V_{262}/R_{222})]\times R_{223} \quad (5)$$

wherein $V_{262}$ is the voltage on the node 262. Because the voltage $V_{262}$ on the node 262 is equal to the voltage drop across the BJT transistor 230, the voltage $V_{262}$ on the node 262 therefore decreases with an increase of the temperature. The level ($V_{262}/R_{222}$) of the current $I_2$ therefore has a negative temperature coefficient. In addition, because the operational amplifier 270 clamps the voltage on the node 262 to the voltage on the node 261 which is a terminal of the resistor 221, and the BJT transistors 231, 232, . . . , 23N coupled to the resistor 221 have a negative temperature coefficient, the voltage drop ΔV therefore increases with an increase of the temperature. The level ($\Delta V/R_{221}$) of the current $I_1$ therefore has a positive temperature coefficient. The combined current ($I_1'+I_2'$) obtained by combining the current $I_1'$ with the current $I_2'$ therefore has a zero temperature coefficient, and the reference voltage $V_{ref}$ also has a zero temperature coefficient and does not change with temperature.

Figure 1A:
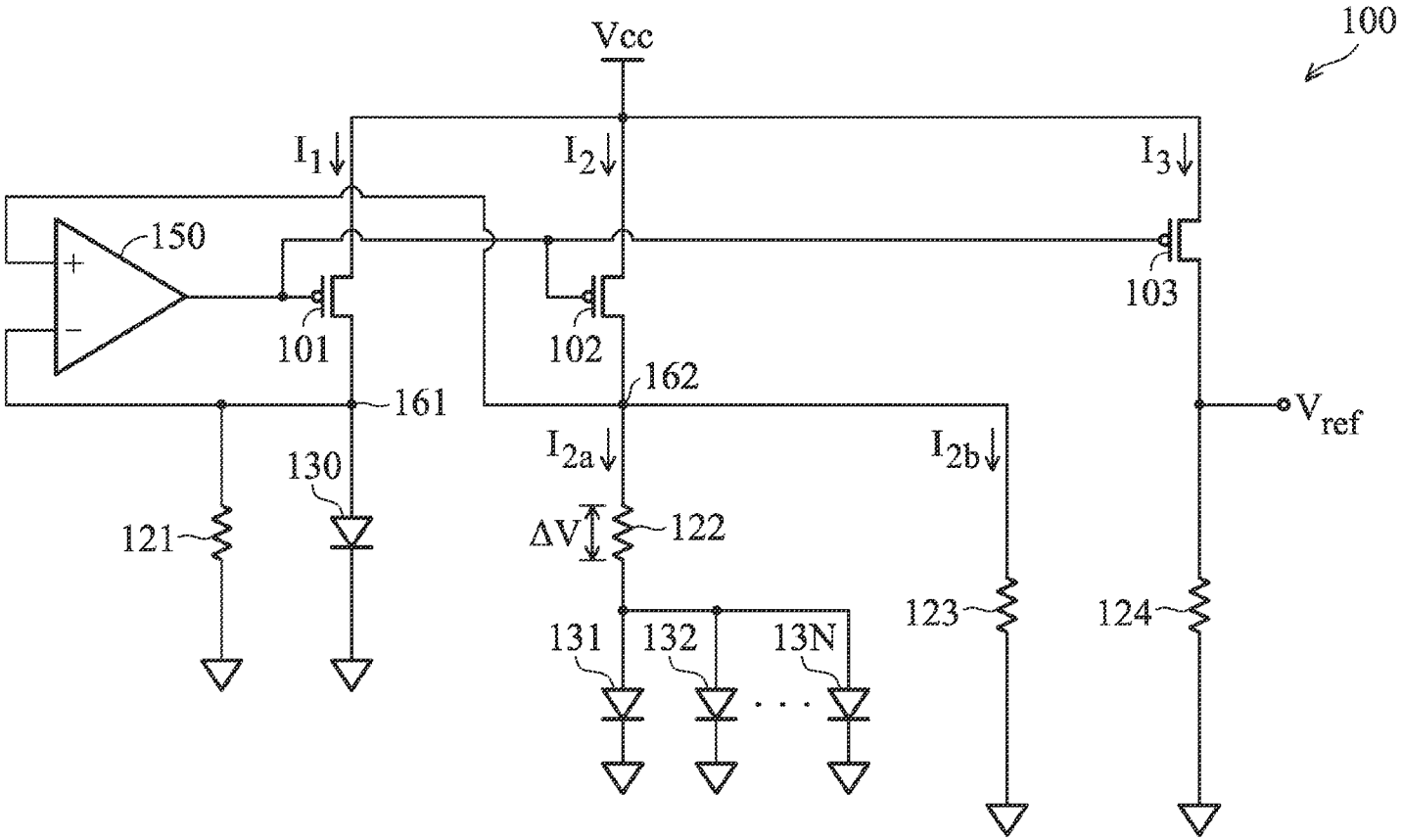
FIG. 1A ( PRIOR ART )
FIG. 1A is a circuit diagram of a bandgap reference voltage generator.
Figure 1B:
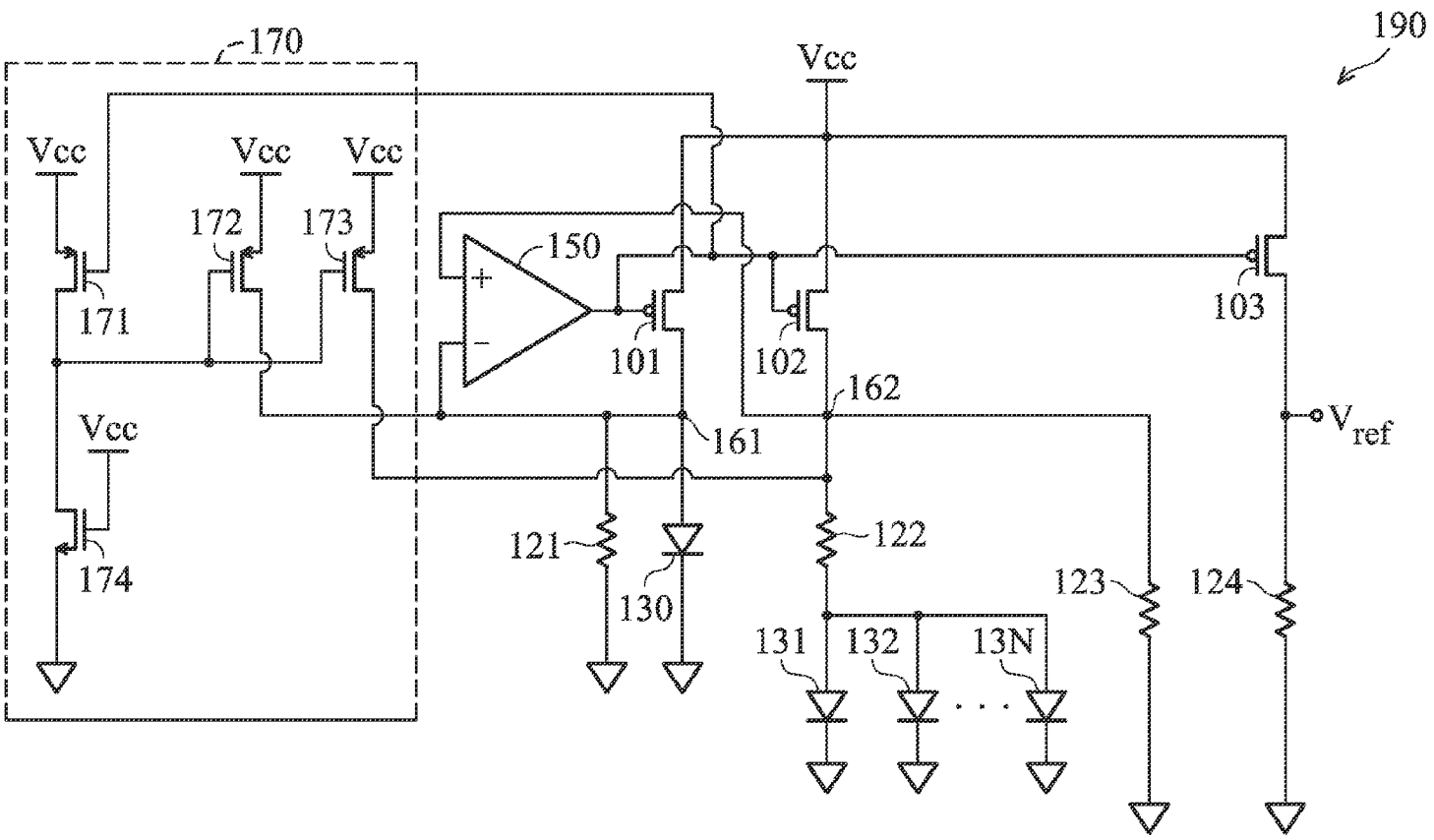
FIG. 1B ( PRIOR ART )
FIG. 1B is a circuit diagram of a starting circuit of the bandgap reference voltage generator shown in FIG. 1A.

Finally, the bandgap reference voltage generator 100 shown in FIG. 1 has error operations due to turning off of the BJT transistor 130 because the BJT transistor 130 and the resistor 121 are both coupled between the node 161 and the ground. The BJT transistor 230 of the invention, however, is coupled between the node 262 and the ground. Because there are not any other resistors coupled between the node 262 and the ground, the BJT transistor 230 of the bandgap reference voltage generator 200 will not be turned off, and no error operations of the bandgap reference voltage generator 200 are resulted. The bandgap reference voltage generator 200 of the invention therefore provides an accurate and reliable reference voltage and has a better performance than that of the conventional bandgap reference voltage generator 100 shown in FIG. 1A.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bandgap reference voltage generator, comprising:

a first current generator, generating a first current with a positive temperature coefficient;

a second current generator, generating a second current with a negative temperature coefficient;

an output voltage generator, generating a third current with a level equal to that of the first current, generating a fourth current with a level equal to that of the second current, adding the third current to the fourth current to obtain a combined current with a zero temperature coefficient, and generating a reference voltage according to the combined current; and a voltage clamp circuit, clamping a voltage of a second node and a voltage of a third node of the second current generator to a voltage of a first node of the first current generator, generating a first voltage supplied to the first current generator, the second current generator, and the output voltage generator, and generating a second voltage supplied to the second current generator and the output voltage generator.

2. The bandgap reference voltage generator as claimed in claim 1, wherein the voltage clamping circuit comprises:

a first operational amplifier, having a positive input terminal coupled to the first node, having a negative input terminal coupled to the second node, and having an output terminal generating the first voltage; and a second operational amplifier, having a positive input terminal coupled to the third node, having a negative input terminal coupled to the second node, and having an output node generating the second voltage.

3. The bandgap reference voltage generator as claimed in claim 1, wherein the first current generator comprises:

a first PMOS transistor, coupled between a voltage source and the first node, having a gate coupled to the first voltage;

a first transistor, coupled between the first node and a fourth node; and a plurality of first BJT transistors, coupled between the fourth node and a ground, having a base coupled to a collector thereof;

wherein the first current flows though the source and the drain of the first PMOS transistor.

4. The bandgap reference voltage generator as claimed in claim 1, wherein the second current generator comprises:

a second PMOS transistor, coupled between a voltage source and the second node, having a gate coupled to the first voltage;

a second BJT transistor, coupled between the second node and a ground, having a base coupled to a collector thereof;

a third PMOS transistor, coupled between the voltage source and the third node, having a gate coupled to the second voltage; and a second transistor, coupled between the third node and the ground;

wherein the second current flows through the source and the drain of the third PMOS transistor.

5. The bandgap reference voltage generator as claimed in claim 1, wherein the output voltage generator comprises:

a fourth PMOS transistor, coupled between a voltage source and a fifth node, having a gate coupled to the first voltage;

a fifth PMOS transistor, coupled between the voltage source and the fifth node, having a gate coupled to the second voltage; and a third transistor, coupled between the fifth node and a ground;

wherein the third current flows through the source and the drain of the fourth PMOS transistor, the fourth current flows through the source and the drain of the fifth PMOS transistor, the combined current flows through the third transistor, and the reference voltage is the voltage difference across the terminals of the third transistor.

6. The bandgap reference voltage generator as claimed in claim 1, wherein the levels of the first current and the third current increase with an increase of the temperature, the levels of the second current and the fourth current decrease with the increase of the temperature, and the combined current does not change with the temperature.

7. A bandgap reference voltage generator, coupled between a voltage source and a ground, comprising:

a first current generator, generating a first current with a positive temperature coefficient;

a second current generator, generating a second current with a negative temperature coefficient;

a voltage clamp circuit, clamping a voltage of a second node and a voltage of a third node of the second current generator to a voltage of a first node of the first current generator, and generating a first voltage and a second voltage; and an output voltage generator, generating a combined current with a zero temperature coefficient according to the first current and the second current, and generating a reference voltage according to the combined current.

8. The bandgap reference voltage generator as claimed in claim 7, wherein the voltage clamping circuit comprises:

a first operational amplifier, having a positive input terminal coupled to the first node, having a negative input terminal coupled to the second node, and having an output terminal generating the first voltage; and a second operational amplifier, having a positive input terminal coupled to the third node, having a negative input terminal coupled to the second node, and having an output node generating the second voltage.

9. The bandgap reference voltage generator as claimed in claim 7, wherein the first current generator comprises:

a first PMOS transistor, coupled between the voltage source and the first node, having a gate coupled to the first voltage;

a first transistor, coupled between the first node and a fourth node; and a plurality of first BJT transistors, coupled between the fourth node and the ground, having a base coupled to a collector thereof;

wherein the first current flows though the source and the drain of the first PMOS transistor.

10. The bandgap reference voltage generator as claimed in claim 7, wherein the second current generator comprises:

a second PMOS transistor, coupled between the voltage source and the second node, having a gate coupled to the first voltage;

a second BJT transistor, coupled between the second node and the ground, having a base coupled to a collector thereof;

a third PMOS transistor, coupled between the voltage source and the third node, having a gate coupled to the second voltage; and a second transistor, coupled between the third node and the ground;

wherein the second current flows through the source and the drain of the third PMOS transistor.

11. The bandgap reference voltage generator as claimed in claim 7, wherein the output voltage generator comprises:

a fourth PMOS transistor, coupled between the voltage source and a fifth node, having a gate coupled to the first voltage;

a fifth PMOS transistor, coupled between the voltage source and the fifth node, having a gate coupled to the second voltage; and a third transistor, coupled between the fifth node and the ground;

wherein the combined current flows through the third transistor, and the reference voltage is the voltage difference across the terminals of the third transistor.

12. The bandgap reference voltage generator as claimed in claim 7, wherein the level of the first current increases with an increase of the temperature, the level of the second current decreases with the increase of the temperature, and the combined current does not change with the temperature.

* * * * *